US006899325B2

(12) United States Patent
Steinert et al.

(10) Patent No.: US 6,899,325 B2
(45) Date of Patent: May 31, 2005

(54) METHOD AND DEVICE FOR PRECISELY ALIGNING A PRODUCT TO BE STAPLED IN RELATION TO A STAPLING DEVICE AND GATHERER STAPLER

(75) Inventors: Andreas Steinert, Leipzig (DE); Randolf Voigtländer, Colditz (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 282 days.

(21) Appl. No.: 10/235,097

(22) Filed: Sep. 5, 2002

(65) Prior Publication Data

US 2003/0061700 A1 Apr. 3, 2003

(30) Foreign Application Priority Data

Sep. 5, 2001 (DE) ..... 101 43 571

(51) Int. Cl.[7] ..... B65H 37/04; B42B 2/00

(52) U.S. Cl. ..... 270/52.18; 270/58.08; 270/58.09; 227/6; 227/7

(58) Field of Search ..... 270/52.18, 52.16, 270/58.08, 58.09, 52.29; 227/2, 5, 6, 7, 44

(56) References Cited

U.S. PATENT DOCUMENTS 5,918,729 A * 7/1999 Chang ..... 198/810.04
5,957,263 A * 9/1999 Espenschied ..... 198/349.95
6,142,353 A * 11/2000 Boss et al. ..... 227/44
6,328,297 B1 * 12/2001 Antonelli et al. ..... 270/52.16

FOREIGN PATENT DOCUMENTS

| | | |
|---|---|---|
| DE | 19 30 128 C2 | 1/1970 |
| EP | 0 641 673 A1 | 3/1995 |
| EP | 0 917 965 A1 | 5/1999 |

* cited by examiner

*Primary Examiner*—Patrick Mackey
(74) *Attorney, Agent, or Firm*—Laurence A. Greenberg; Werner H. Stemer; Ralph E. Locher

(57) ABSTRACT

A method for precisely aligning a product to be stapled in relation to a stapling device in a gatherer stapler, includes the steps of determining an exact position of the product to be stapled, comparing the determined position with an expected position of the product, supplying a determined positional deviation to a drive as a control variable and performing a compensatory movement by controlling at least one of respective drives of the gathering chain and of the stapling device so that the determined positional deviation is compensated for at the start of the stapling operation. A device for performing the method and a gatherer stapler are also provided.

8 Claims, 3 Drawing Sheets

METHOD AND DEVICE FOR PRECISELY ALIGNING A PRODUCT TO BE STAPLED IN RELATION TO A STAPLING DEVICE AND GATHERER STAPLER

BACKGROUND OF THE INVENTION

Field of the Invention

The invention relates to a method for precisely aligning a product to be stapled in relation to a stapling device in a gatherer stapler. The invention also relates to a correspondingly constructed gatherer stapler.

Gatherer staplers are paper-processing machines with which a product, for example a brochure, is assembled from a plurality of folded sheets and is stapled. Printed folded sheets from sheet piles or stacks are supplied separately lying on folded sheet feeders or standing on the spine, are opened and placed on a gathering chain. The number of folded sheets to be stapled is gathered and aligned on the gathering chain by drivers. The gathering chain transports the gathered folded sheets to a stapling device, whereat they are stapled with wire staples by suitable stapling heads. In order to trim the edge of the stapled products, there is usually provided downstream from an ejector, a so-called trimmer from which the end products are transported onward to a delivery.

In gatherer staplers, a distinction is drawn between two types of stapling: stapling at a standstill and stapling while moving.

In order to perform stapling at a standstill, the product must be stopped. A disadvantage thereof is that the product may change its position because of disruptive influences during retardation and acceleration of the movement thereof.

In order to staple the moving product, the stapling device, including a stapling carriage and a staple lifting device, have to be moved together with the product to be stapled and, at least for some time interval, must be coordinated with the movement of the product. The coordination of the movement of the stapling device is carried out, in this regard, in relation to the movement of the gathering chain which transports the product to be stapled. Then, the position of the product is determined by the composition of the gathering chain, more particularly by the composition of the drivers of the gathering chain. In this type of stapling, deviations occur between the actual staple position and the desired staple position, and the deviations may be pronounced to a different extent from product to product. Deviations of the staple position result, amongst others, from the fact that the movement of the stapling device is coordinated with the movement of the gathering chain and, at the same time, it is assumed that the product to be stapled is precisely guided by the gathering chain.

European Patent EP 0 917 965 reveals a gatherer stapler for folded sheets and a method for controlling the drive of a gatherer stapler. The gatherer stapler for folded sheets disclosed therein has a stapling station and at least one folded sheet feeder, a gathering chain and a drive. In order to permit flexible use and operation of the gatherer stapler, the drive comprises individual drive units, of which, respectively, one drive unit is associated with the stapling station, each folded sheet feeder and the gathering chain, and each of the individual drive units has at least one electric motor and at least one control unit associated therewith. Also provided is a connection for the interchange of data and/or control signals between the control units.

Due to tolerances in the length of the gathering chain pitch, due to tolerances and positional deviations of the drivers, and due to tolerances in the chain guide elements, the actual position of the product to be stapled deviates from the expected position in the transport direction.

Heretofore, attempts have been made to minimize the foregoing deficiency by predefining or prescribing close tolerances for the components which are used. Wear phenomena, for example, of the gathering chain, lead to changes in the length of the chain segments with increasing duration of operation. Consequently, the deviation of the staple position is increased.

SUMMARY OF THE INVENTION

It is accordingly an object of the invention to provide a method and a device for precisely aligning a product to be stapled in relation to a stapling device and a gatherer stapler, which overcome the hereinafore-mentioned disadvantages of the heretofore-known methods and devices of this general type when stapling during movement.

With the foregoing and other objects in view, there is provided, in accordance with the invention, a method for precisely aligning a product to be stapled in relation to a stapling device in a gatherer stapler. The method comprises determining the exact position of the product to be stapled, comparing the determined position with an expected position of the product and supplying a determined positional deviation to a drive as a control variable. A compensatory movement is performed by controlling at least one of respective drives of the gathering chain and of the stapling device so that the determined positional deviation is compensated for at the start of the stapling operation.

In accordance with another mode, the method of the invention further comprises performing the required compensatory movement within one movement cycle generally corresponding to one machine cycle.

In accordance with a further mode, the method of the invention further comprises making the performed compensatory movement reversible again until a next machine cycle.

In accordance with an added mode, the method of the invention further comprises taking the performed compensatory movement into account appropriately in a compensatory movement for a next product to be stapled.

With the objects of the invention in view, there is also provided a device for precisely aligning a product to be stapled in relation to a stapling device in a gatherer stapler. The device comprises equipment for determining an exact position of the product to be stapled, for comparing the determined position with an expected position of the product, for supplying a determined positional deviation to a drive as a control variable and for performing a compensatory movement by controlling at least one of respective drives of a gathering chain and of the stapling device. In this way, the determined positional deviation is compensated for at the start of the stapling operation.

With the objects of the invention in view, there is additionally provided a gatherer stapler, comprising a gathering chain and a stapling device having at least two separate drives. A registering device is provided for registering the position of the product to be stapled. An evaluation unit is provided for comparing the registered actual position, as determined, with an expected position of the product to be stapled. A control unit is provided for supplying a determined positional deviation to at least one of the drives as a control variable.

In accordance with an additional feature of the invention, the registering device is located immediately upstream of the stapling device in travel direction of the gathering chain.

In accordance with a concomitant feature of the invention, the registering device includes at least one sensor.

In a preferred embodiment, accordingly, the gatherer stapler has at least two separate drives for the stapling device and for the gathering chain. Furthermore, there is provided a sensor for registering the position of the product to be stapled. The sensor is advantageously located immediately upstream of the stapling device in the travel direction of the gathering chain. Using this sensor, the actual position of the product in the travel direction is registered exactly and compared in an evaluation unit with the expected position of the product. A positional deviation determined in the process is supplied to the drive unit by a control unit as a control variable. In the drive unit, the drive of the gathering chain and/or the drive of the stapling device are controlled so that the positional deviation determined at the time of measurement is compensated for up to the start of the stapling operation for this product. Consequently, the actual position and the intended position of the product are in agreement. As a result, the staple is formed exactly at the predetermined point on the product.

In a further preferred embodiment, the performed compensatory movement is made reversible again until the next machine cycle, or is taken into account appropriately in the compensatory movement for the next product. This ensures that the position of the staple in the following product is not impaired.

Other features which are considered as characteristic for the invention are set forth in the appended claims.

Although the invention is illustrated and described herein as embodied in a method and a device for precisely aligning a product to be stapled in relation to a stapling device and a gatherer stapler, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
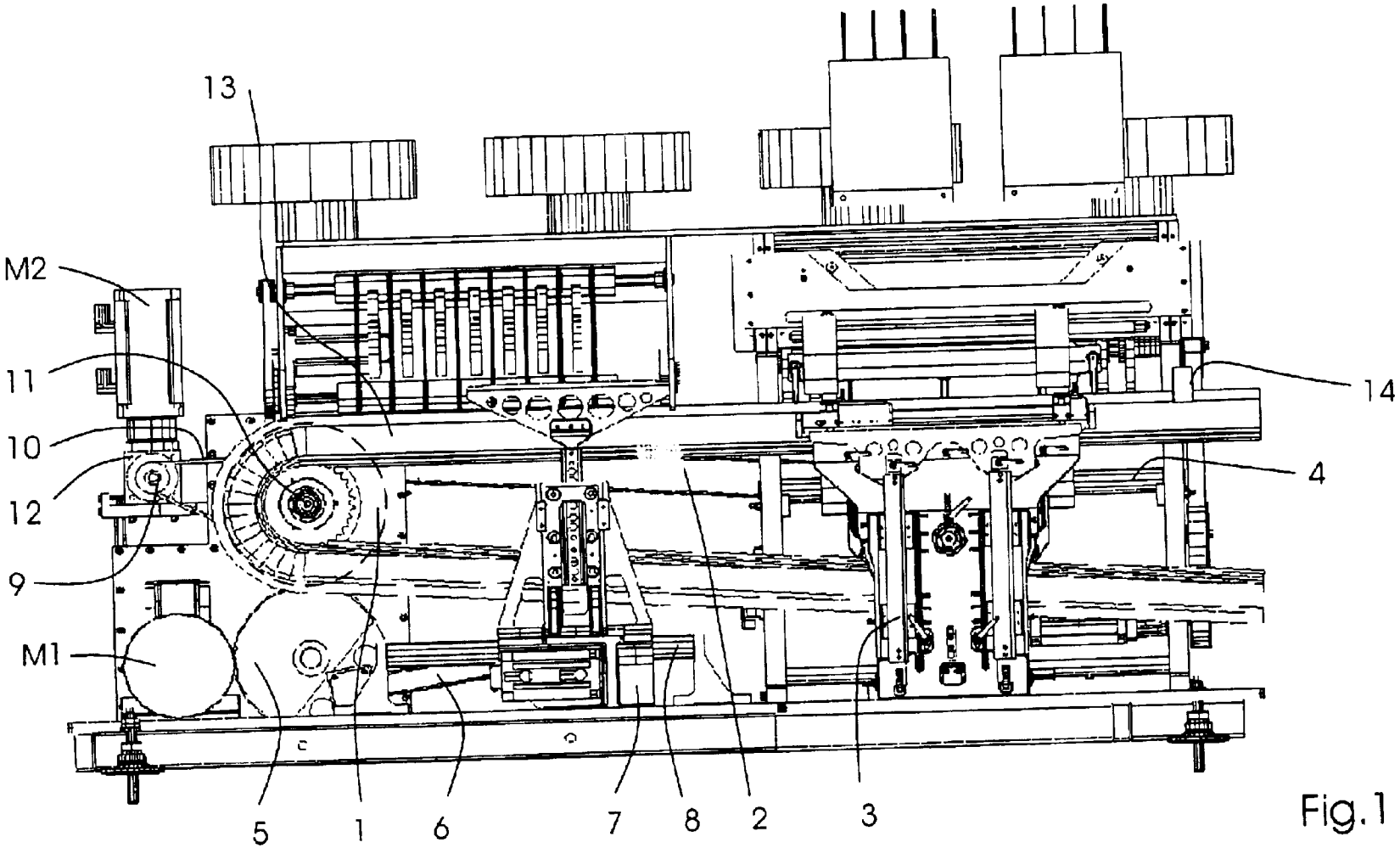
FIG. 1 is a diagrammatic, side-elevational view of a gatherer stapler with separate drives and a sensor.
Figure 2:
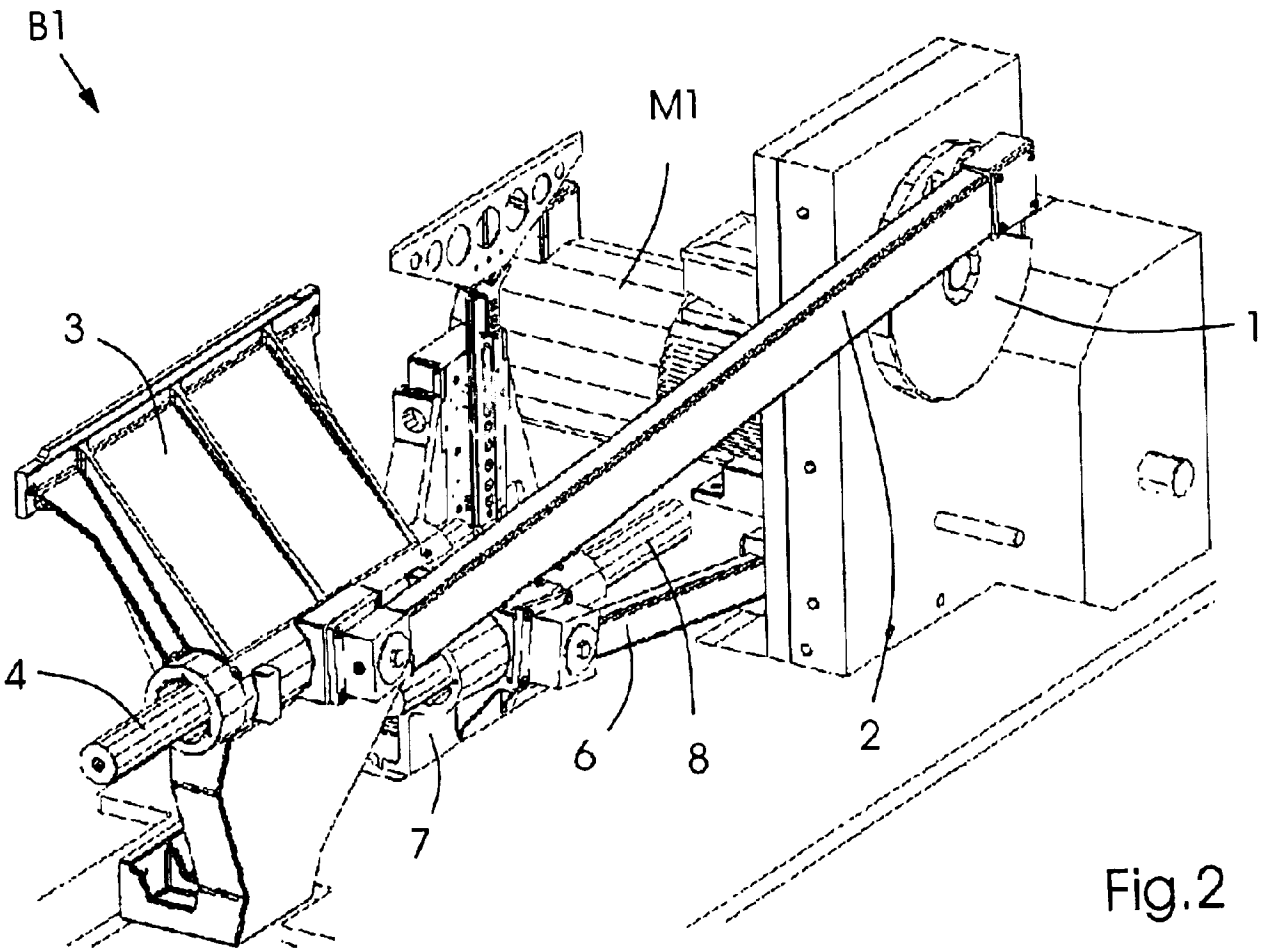
FIG. 2 is a fragmentary perspective view of FIG. 1, showing one of the drives, namely a drive of a stapling carriage.
Figure 3:
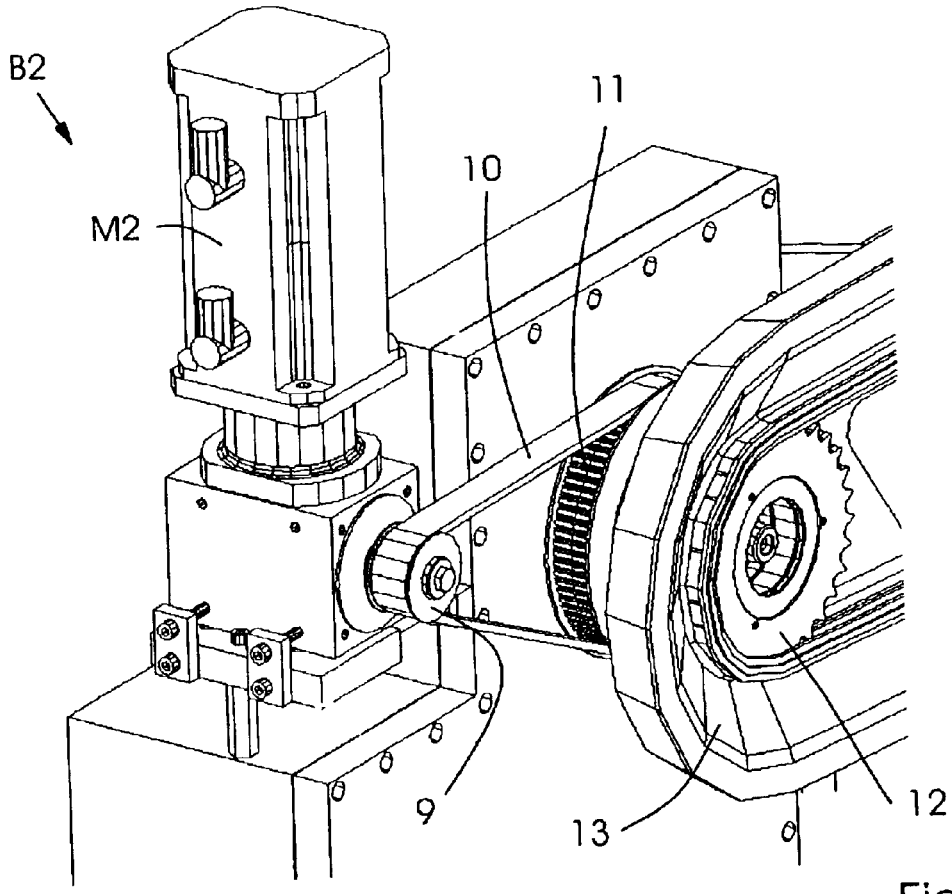
FIG. 3 is an enlarged, fragmentary, perspective view of FIG. 1, showing another of the drives, namely a drive of a gathering chain.

Referring now to the figures of the drawings in detail and first, particularly to FIG. 1 thereof, there is seen a representative example of a gatherer stapler according to the invention. A drive motor M1 drives a stapling carriage 3, which is mounted on a rectilinear thrust mechanism 4, through a crank 1 and a connecting rod 2. A crank 5 and a connecting rod 6 ensure that a knife or blade carriage 7 is reciprocatingly movable horizontally along a rectilinear thrust mechanism 8. A drive motor M2 is provided for a gathering chain 13 which is driven by a toothed-belt wheel or pulley 9, a toothed belt 10, a toothed-belt wheel or pulley 11 and a sprocket 12. Provision is made for these two motors M1 and M2 to be driven so that the movements of the stapling carriage B1 and of the gathering chain B2, which are shown in FIGS. 2 and 3, respectively, can be coordinated with one another. The movements are coordinated by a sensor 14 provided for registering the position of the product to be stapled. This sensor 14 is advantageously located immediately upstream from the stapling device in the running or travel direction of the gathering chain B13. By this sensor 14, it is then possible to register the actual position of the product exactly in the travel direction thereof. The values which are determined are passed on to a non-illustrated evaluation unit and, in the latter, are compared with the expected position of the product. A positional deviation determined during this comparison is fed to the drive unit by a non-illustrated control unit as a control variable. It is then possible, by this control variable, to control the drive of the gathering chain and/or the drive of the stapling device so that a positional deviation of the product, which may be determined at the time of measurement, is compensated for up to the start of the stapling operation for this product. This control ensures that the staple is always placed exactly at a predetermined point on the product.

As already mentioned hereinbefore, a performed compensatory movement is made reversible again until the next machine cycle or taken into account appropriately during the compensatory movement for the next product. This ensures that the staple for the following product is also placed at a correct point.

The important elements of the drive of the stapling carriage B1 are shown in FIG. 2. The motor M1 drives the crank 1 which, by the connecting rod 2, implements or realizes the horizontal movement of the stapling carriage 3 along the rectilinear thrust mechanism 4. At the same time, the drive motor M1 moves a crank, hidden in this view, which together with the connecting rod 6 implements or realizes the horizontal movement of the knife or blade carriage 7 along the rectilinear thrust mechanism 8.

The drive of the gathering chain B2 is illustrated in FIG. 3. The motor M2 moves a toothed-belt pulley 9 which, by the toothed belt 10, transmits rotational movement to the toothed-belt pulley 11. The gathering chain 13 is therefore driven by the sprocket 12 which is disposed downstream.

We claim:

1. A method for precisely aligning a product to be stapled in relation to a stapling device having a drive in a gatherer stapler having a gathering chain with a drive, the method which comprises:

determining an exact position of the product to be stapled;

comparing the determined position with an expected position of the product;

supplying a determined positional deviation to at least one of the drives as a control variable; and performing a compensatory movement by controlling at least one of the drives to compensate for the determined positional deviation at a start of a stapling operation.

2. The method according to claim 1, which further comprises performing the required compensatory movement within one movement cycle generally corresponding to one machine cycle.

3. The method according to claim 1, which further comprises making the performed compensatory movement reversible again until a next machine cycle.

4. The method according to claim 1, which further comprises taking the performed compensatory movement into account appropriately in a compensatory movement for a next product to be stapled.

5. A device for precisely aligning a product to be stapled in relation to a stapling device having a drive in a gatherer stapler having a gathering chain with a drive, comprising:

a device for determining an exact position of the product to be stapled;

a device for comparing said determined position with an expected position of the product;

a device for supplying a determined positional deviation to at least one of the drives as a control variable; and a device for performing a compensatory movement by controlling at least one of the drives to compensate for said determined positional deviation at a start of a stapling operation.

6. A gatherer stapler, comprising:

a gathering chain and a stapling device having at least two separate drives;

a registering device for determining and registering an actual position of a product to be stapled;

an evaluation unit for comparing the registered actual position, as determined, with an expected position of the product to be stapled; and a control unit for supplying a determined positional deviation to at least one of said drives as a control variable.

7. The gatherer stapler according to claim 6, wherein said registering device is located immediately upstream of said stapling device in travel direction of said gathering chain.

8. The gatherer stapler according to claim 6, wherein said registering device includes at least one sensor.

* * * * *